US006326615B1

(12) United States Patent
Syage et al.

(10) Patent No.: US 6,326,615 B1
(45) Date of Patent: Dec. 4, 2001

(54) RAPID RESPONSE MASS SPECTROMETER SYSTEM

(75) Inventors: Jack A. Syage, Huntington Beach; Karl A. Hanold, Irvine, both of CA (US)

(73) Assignee: Syagen Technology, Tustin, CA (US)

( * ) Notice: Subject to any disclaimer, the term of this patent is extended or adjusted under 35 U.S.C. 154(b) by 0 days.

(21) Appl. No.: 09/386,577

(22) Filed: Aug. 30, 1999

(51) Int. Cl.[7] ..... H01J 49/16

(52) U.S. Cl. ..... 250/287; 250/288; 250/292; 250/423 R

(58) Field of Search ..... 250/287, 288, 250/292, 423 R

(56) References Cited

U.S. PATENT DOCUMENTS

| | | | | |
|---|---|---|---|---|
| 4,365,157 | | 12/1982 | Unsold et al. . | |
| 4,540,884 | | 9/1985 | Stafford et al. . | |
| 4,733,073 | | 3/1988 | Becker et al. . | |
| 4,780,608 | | 10/1988 | Cross et al. . | |
| 4,849,628 | | 7/1989 | McLuckey et al. . | |
| 4,861,988 | | 8/1989 | Henion et al. . | |
| 4,931,640 | | 6/1990 | Marshall et al. . | |
| 5,070,240 | | 12/1991 | Lee et al. . | |
| 5,206,594 | | 4/1993 | Zipf . | |
| 5,283,436 | | 2/1994 | Wang . | |
| 5,393,979 | | 2/1995 | Hsi . | |
| 5,397,895 | | 3/1995 | Leone et al. . | |
| 5,504,328 | | 4/1996 | Bonser . | |
| 5,554,846 | | 9/1996 | Regiee et al. . | |
| 5,569,917 | | 10/1996 | Buttrill, Jr. et al. . | |
| 5,631,462 | | 5/1997 | Reents, Jr. . | |
| 5,808,299 | | 9/1998 | Syage . | |
| 5,854,431 | | 12/1998 | Linker et al. . | |
| 5,869,832 | * | 5/1999 | Kang et al. | 250/288 |
| 6,011,259 | * | 1/2000 | Whitehouse et al. | 250/287 |
| 6,040,575 | * | 3/2000 | Whitehouse et al. | 250/287 |
| 6,140,638 | * | 10/2000 | Tanner et al. | 250/292 |

OTHER PUBLICATIONS

Mahon, McIlrath, Myerscough, Koopman, Third–Harmonic Generation in Argon, Krypton, and Xenon: Bandwidth Limitations in the Vicinity of Lyman–α, 1979, Eight (8) pages, vol. QE–15, IEEE.

R. Wallenstein, Generation of Narrowband Tunable VUV Radiation at the Lyman –α Wavelength, Apr. 1980, Four (4) pages, vol. 33 No. 1, Optics Communication, West Germany.

R. Hilbig and R. Wallenstein, Tunable VUV Radiation Generated by Two–Photon Resonant Frequency Mixing in Xenon, Feb. 1983, vol. QE–19, IEEE.

C. Rettner, E. Marinero, R. Zare, A. Kung, Pulsed Free Jets: Novel Nonlinear Media for Generation of Vacuum Ultrviolet and Extreme Ultrviolet Radiation, 1984, Seven (7) pages, American Chemical Society.

Roger Tembreull and David M. Lubman, Pulsed Laser Desorption of Biological Molecules in Supersonic Beam Mass Spectrometry with Resonant Two–Photon Ionization Detection, Apr. 15, 1987, Seven (7) pages, Analytical Chemistry, vol. 59, No. 8, Michigan.

(List continued on next page.)

*Primary Examiner*—Kiet T. Nguyen
(74) *Attorney, Agent, or Firm*—Irell & Manella, LLP

(57) ABSTRACT

A high speed mass spectrometer system capable of detecting in real-time multiple compounds in complex environments. This system includes a continuous ionization source coupled to a quadrupole ion trap to store ions, to filter ions for detection, to resonantly excite the ion trajectories to cause them to dissociate for more detailed analysis. This system includes a dual ionization configuration to cover broad and disparate classes of compounds. A glow discharge source is used to attach electrons to molecules with high electrons affinity. A photoionization source is used to detach electrons from molecules with low ionization potentials.

17 Claims, 8 Drawing Sheets

OTHER PUBLICATIONS

E.R. Rohwer, R.C. Beavis, C. Koster, J. Lindner, J. Grotemeyer and E.W. Schlag, Fast Pulsed Laser Induced Electron Generation for Electron Impact Mass Spectrometry, Nov. 23, 1988.

Russell G. Tonkyn and Michael G. White, Compact Vacuum Ultrviolet Source for Photoelectron Spectroscopy, Mar. 20, 1989, Seven (7) pages, American Institute of Physics.

J.G. Boyle, L.D. Pfefferle, E.E. Gulcicek, S.D. Colson, Laser–driven Electron Ionization for a VUV Photoionization Time–of–Flight Mass Spectrometer, Oct. 1990, Eleven (11) pages, American Institute of Physics.

David M. Lubman, Lasers and Mass Spectrometry, 1990, Twelve (12) pages, Oxford University Press, New York, Oxford.

Jack A. Syage, Real–Time Detection of Chemical Ageuis Using Molecular Beam Laser Mass Spectrometry, 1990, Five (5) pages, American Chemical Society.

R. Frey, A. Holle, H. Betzold, W. Ulke, U. Boest, Real–Time Vehicle Exhaust Analysis Using a Laser TOF Mass Spectrometer, 1992, Two (2) pages.

Steven M. Michael, Mingta Chien and David M. Lubman, An Ion Trap Storage/Time–of–Flight Mass Spectrometer, Jun. 17, 1992, Four (4) pages, American Institute of Physiscs, Michigan.

P.Y.Cheng and H.L. Dai, A Photoemitted Electron–Impact Ionization Method for Time–of–Flight Mass Spectrometers, May 12, 1993, Four (4) pages, American Institute of Physics.

U. Boesl, R. Weinkauf, C. Weickhardt, E.W. Schlag, Laser Ion Sources for Time–of–Flight Mass Spectrometry, Thirty–Eight (38) pages, Sep. 14, 1993.

Dale R. Nesselrodt and Tomas Baer, Cyclic Ketone Mixture Analysis Using 2+1 Resonance–Enhanced Multiphoton Ionization Mass Spectrometry, Aug. 1, 1994, Eight (8) pages, vol. 66, No. 15, Analytical Chemistry.

Mark G. Qian and David M. Lubman, A Marriage made in MS, Apr. 1, 1995, Four (4) pages, vol. 67, No. 7, Analytical Chemistry.

* cited by examiner

300

RAPID RESPONSE MASS SPECTROMETER SYSTEM

BACKGROUND OF THE INVENTION

1. Field of the Invention

The present invention relates to a mass spectrometer which has a glow discharge ionizer and a photoionizer that are coupled to a mass detector(s) by quadrupole ion traps.

2. Background Information

Terrorists have been known to use explosives to hijack commercial aircraft. For this reason, there has been a desire to provide an explosive detection system that can be operated "on-site" at an airport terminal. An on-site detection system must be capable of detecting extremely low concentrations of an explosive(s) material in a relatively fast time frame to minimize the time delays in air travel for the passengers.

U.S. Pat. No. 5,854,431 issued to Linker et al. and assigned to Sandia Corporation ("Sandia") discloses a preconcentrator system that generates a flow of air to dislodge explosive material from a passenger. The dislodged explosive material is captured by a screen of the system. The air flow across the passenger is temporarily terminated to allow the captured explosive material to be removed from the screen by a secondary flow of air. The explosive material removed from the screen is directed into a particle detector. The preconcentrator disclosed in the Sandia patent increases the concentration of explosive material provided to the detector.

U.S. Pat. No. 4,849,628 issued to McLuckey et al. ("McLuckey") discloses a mass detection system that can detect relatively low concentrations of a trace molecule(s). McLuckey utilizes a glow discharge ionizer which ionizes an "atmospheric" sample. Providing an air sample at atmospheric pressures increases the density of the sample and the number of ionized molecules. Increasing the number of ions improves the sensitivity of the detector.

The glow discharge ionizer includes a pair of electrodes separated by a chamber. A voltage potential is created between the electrodes to induce a glow discharge which ionizes a gas sample within the chamber. The glow discharge ionizer of McLuckey is coupled to a quadrupole mass spectrometer that can detect a trace molecule such as an explosive material.

The quadrupole mass spectrometer includes a scanning circuit which provides a continuously varying voltage field across the poles of the spectrometer. The continuously varying voltage field sequentially ejects ionized molecules from the quadrupole to a detector. The excitation circuit and detector can be coupled to a computer which correlates detected molecules with the excitation voltage. Explosive materials will provide detection at a predetermined voltage (s). The computer can correlate detection with an explosive material and inform an operator that an explosive has been detected.

Quadrupole mass spectrometers are relatively slow because of the time required to vary the excitation voltage to sequentially eject the ionized trace molecules. The prior art does include time of flight mass spectrometers, which simultaneously accelerate all of the ionized molecules toward a detector and then detect the different times when the molecules arrive. The mass of the molecules varies with the different arrival times. Time of flight mass spectrometers are not effective when used with a continuous ionization source such as a glow discharge ionizer. It would be desirable to provide a monitor that can quickly detect trace molecules in relatively low concentrations.

Glow discharge ionizers are efficient in ionizing molecules with high electron affinity but are not generally effective for molecules with low ionization potentials, which generally have low electron affinity. It would also be desirable to provide a monitor that can quickly detect a variety of different trace molecules in relatively low concentrations. For example, it would be desirable to provide an on-site airport terminal detector that can detect explosives as well as other threats and contraband such as chemical weapons and drugs.

SUMMARY OF THE INVENTION

The present invention includes an embodiment of a monitor for detecting a trace molecule from a gas sample. The monitor may include a glow discharge ionizer and a threshold photoionizer, which can ionize a trace molecule from the gas sample. The ionized trace molecule is trapped within a quadrupole ion trap. The quadrupole ion trap is coupled to a mass detector which can detect the ionized trace molecule.

DETAILED DESCRIPTION

Figure 1:
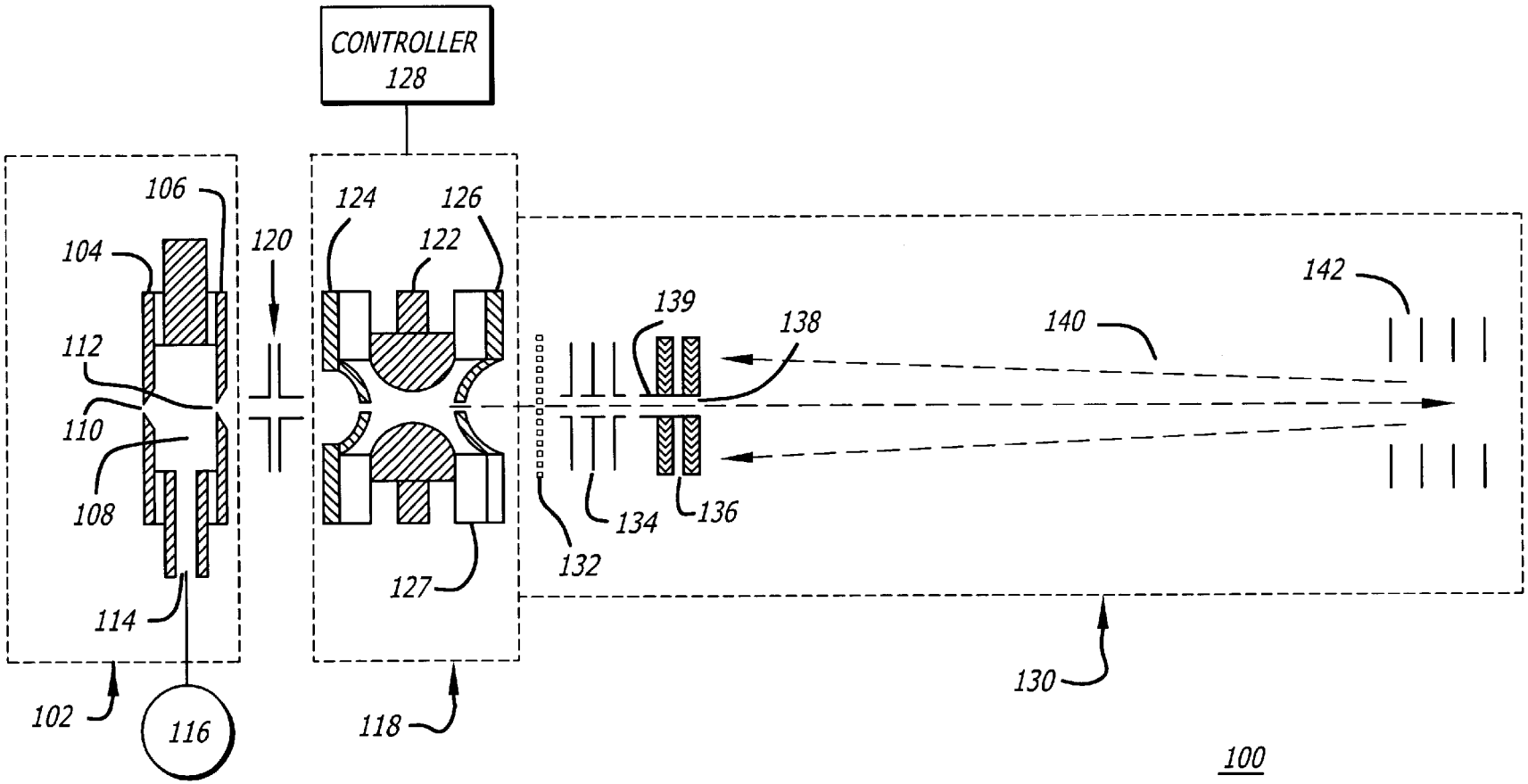
FIG. 1 is a schematic representation of an embodiment of a monitor of the present invention.

Referring to the drawings more particularly by reference numbers, FIG. 1 shows an embodiment of a monitor 100 of the present invention. The monitor 100 is typically used to measure trace molecular constituents from a direct air sample, a sample collector, a preconcentrator, a process line, or from other sources. For purposes of discussion, trace molecular constituents could include small quantities of explosives or chemical agents or other threat compounds, or any other molecules that are to be monitored. The monitor 100 is contained in a vacuum housing that has a pumping device and other standard vacuum components.

The monitor 100 may include a glow discharge ionizer 102 that can receive a gas sample. The glow discharge ionizer 102 may include a first electrode 104 and a second electrode 106 that are separated by a chamber 108. The gas sample may enter the chamber 108 through an aperture 110 in the first electrode 104 and exit the chamber 108 through an aperture 112 in the second electrode 106. The electrodes 104 and 106 may be connected to an electrical circuit(s) (not shown). The electrical circuit may generate a voltage potential between the electrodes 104 and 106 which creates a glow discharge that ionizes trace molecules within the chamber 108.

By way of example, the space between the electrodes 104 and 106 may be approximately about 2 cm, but can be other dimensions. Typically the voltages of electrodes 104 and 106 are about −350 V and 0 V, respectively. The glow discharge ionizer 102 may be similar to the ionizer disclosed in U.S. Pat. No. 4,849,628 issued to McLuckey et al., which is hereby incorporated by reference.

The ionizer 102 may include a port 114 that is in fluid communication with a pump 116. The pump 116 may be used to pump out the ionization chamber in order to keep the residence time of the sample to a minimum, which improves detection time response, and to handle relatively large sample volumes. The ionizer 102 can also operate with the port 114 sealed, in which case, the residence time in the ionization volume is dictated by the flow through aperture 112. Ions may exit the aperture 112 along with the neutral gas. The ions can be drawn through the aperture 112 by the potential field across the electrodes 104 and 106. This invention also allows for focusing elements in the ionizer 102 to increase the yield of ions that exit aperture 112.

The ions that exit the aperture 112 may be steered into a quadrupole ion trap 118 by electrostatic focusing elements 120. The quadrupole ion trap 118 may trap ions created within the ionizer 102. The quadrupole ion trap 118 may include a ring electrode 122 that is separated from a pair of endcap electrodes 124 and 126 by dielectric material 127. The elements 120 and endcap 124 may function as an einsel lens. Typically, the first and last element of the einsel lens (the first element of 120 and electrode 124) can be biased at the same voltage, such as ground potential, and the middle element (the second element of 120) is biased at a different potential. Alternatively, the lenses can have progressively decreasing potential to accelerate the ions. Other focusing elements have been tested and may include multipole ion guides, such as quadrupole, hexapole, or octapole ion guides. The device can also operate without focusing elements, by relying on the ion velocities through the aperture 112 to carry them to the ion trap 118 or by applying a potential difference from electrodes 106 and 124 to accelerate the ions toward the ion trap 118. The elements 120 and electrodes 122, 124 and 126 may be connected to an electrical circuit(s) 128.

The ions enter the quadrupole ion trap 118 through an aperture 129 in the entrance electrode 122 and are stabilized and stored within the trap 118 by the application of an alternating current to the ring electrode 126 in a manner known in the art. The endcaps 122 and 124 are usually held at a constant voltage, such as ground potential, however, auxiliary oscillating current may be applied. The range of ion masses that are stored efficiently depends on the frequency and amplitude of the current applied to the ring electrode, it is typically of radio frequency (such as 1 MHz) and a few hundred to a few thousand volts peak to peak, but can have other values. The ions may continuously accumulate within the trap 118. Waveforms can be applied to one or both endcap electrodes 122 and 124 and/or to the ring electrode 126 to excite specific ion masses in the trap 118 in order to eject them from stable orbits, to prevent them from accumulating, or to excite them to more energetic orbits to cause them to dissociate with background gas in order to produce fragment ions of the selected ions. Each ion mass has a distinct resonance condition. Many different ion masses may be excited simultaneously by applying a superposition of many frequencies. The frequency spectrum may be generated by a variety of prior art methods. In this embodiment, the arbitrary waveform is formed by superimposing the sum of individual periodic waveforms corresponding to the frequency and amplitude most suited for exciting each ion mass to the desired effect. In one embodiment this waveform may be applied to the exit endcap 126, although it is to be understood that effective excitation may be achieved by application of the waveform to other electrodes in the ion trap as noted above.

Following accumulation of ions and the optional manipulation of ions consisting of selective ion ejection and selective collision-induced ion dissociation, the remaining ions in the quadrupole ion trap 118 are mass analyzed by ejecting all the ions into a mass detector 130. The mass detector 130 may be a time of flight mass spectrometer. Ion ejection to the mass detector 130 may be accomplished by applying a high voltage pulse to the ion trap exit endcap 126. Alternatively, a high voltage pulse may be applied to the entrance endcap 124 to "push" the ions into the detector 130, or two oppositely-phased pulses may be applied to both endcaps 124 and 126 in a "push-pull" manner to extract ions into the detector 130.

The extracted ions can be accelerated to a higher energy by an acceleration grid 132. The accelerated ion pulse may be focused and collimated by a electrostatic lens assembly 134. This is shown as a three-element einsel lens, however other configurations may be used, such as a two-element assembly. The third element in the einsel lens configuration can make use of the back plate of a detector 136.

The accelerated and collimated ion packet passes through a hole 138 in the coaxial detector 136. A cylinder 139 may be provided in the detector hole 138 to keep a uniform voltage potential for the traversing ions and is electrically isolated from the detector plates themselves (described below). The ions travel through a drift tube 140 under field-free conditions where ions of different mass travel at different speeds and spread out in space. The ions may then reach a reflectron section 142 of the mass detector where they are reversed in direction. This operation acts to focus ions of different initial energies in the usual manner. The ions then travel back toward the front of the detector 136 where they impact and are recorded as a signal in the normal manner. The resulting signal from the detector is measured with electronics that can distinguish the different arrival times of different ion masses as is known in the art. Although a reflectron 142 is shown with a coaxial detector in monitor 100, it is to be understood that the reflectron 142 may also be of an off-axis design, or the mass detector 130 may be of a linear design with the detector plate 136 at the end of the drift tube 140.

Figure 2:
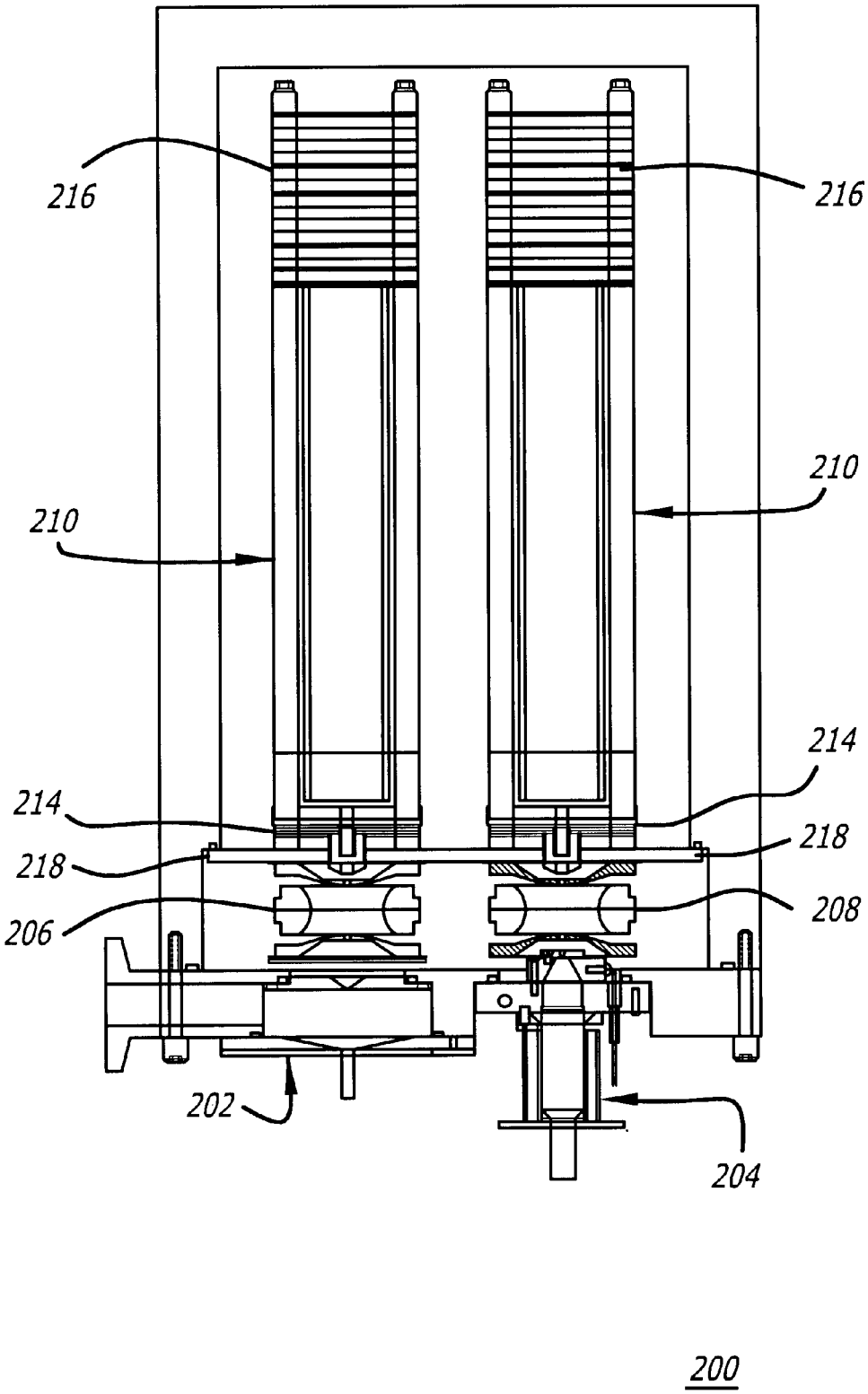
FIG. 2 is a schematic representation of an alternate embodiment of the monitor.

FIG. 2 shows an alternate embodiment of a monitor 200 that incorporates a glow discharge ionizier 202 and a photoionizer 204. The glow discharge ionizer 202 may ionize molecules which have a high electron affinity. The photoionizer 204 may be used to detach electrons from molecules which have low ionization potentials.

Figure 3:
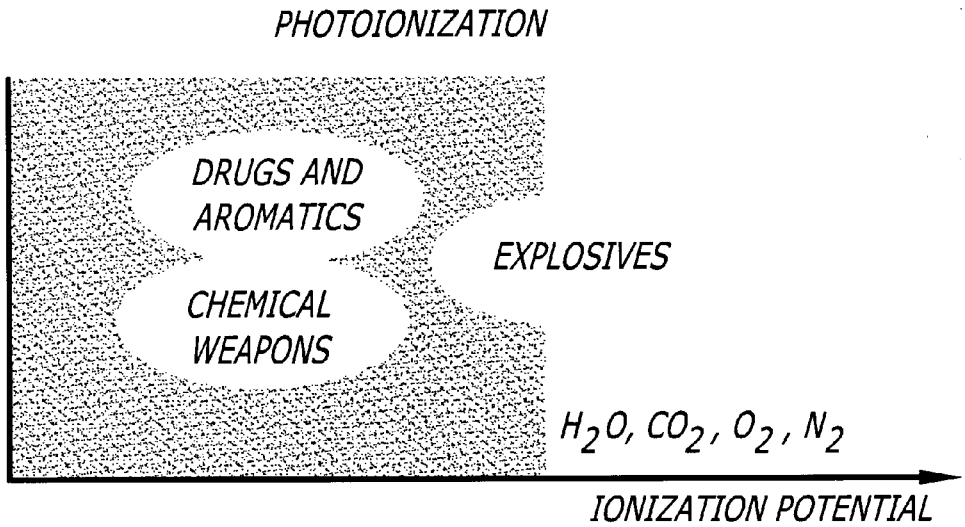
FIG. 3 is a schematic showing the complementary function of photoionization and discharge ionization
Figure 3:
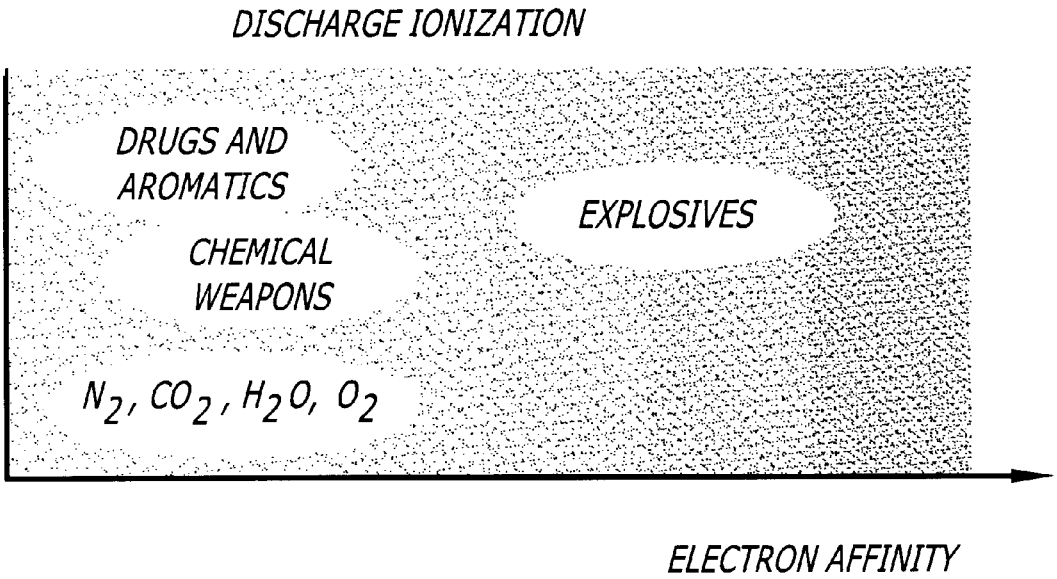
Figure 3:
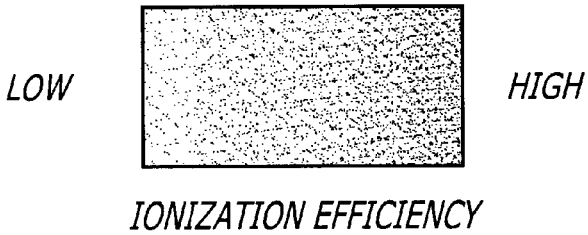

As shown in FIG. 3 drugs and chemical weapons tend to have a low ionization potential while explosive materials tend to have a high electron affinity. The inclusion of both the photoionizer 204 and the glow discharge ionizer 202 provides a single monitor which can effectively ionize a number of different trace molecules to detect a plurality of substances. Such a monitor would be particularly useful when used to detect both explosives, chemical weapons, and drugs at an airport terminal. Photoionization and glow discharge electron attachment are complementary ionization methods that significantly increase the range of compounds that can be detected in one device.

Referring again to FIG. 2, each ionizer 202 and 204 is connected to a corresponding quadrupole ion trap 206 and 208, respectively, and mass detectors 210. Each detector 210 may include a coaxial detector and focusing lens assembly 214, a reflectron section 216, and other components. The operation of the combined glow discharge ionizer 202, ion trap 206 and mass detector 210 may be similar to the system shown in FIG. 1.

The photoionizer 204, ion trap 208 and detector 210 may function in a manner similar to the glow discharge section of the monitor 200. The photoionizer 204 typically operates in positive ion mode compared to the glow discharge ionizer 202, which typically operates in a negative ion mode. The monitor 200 may include partitions 218 that separates the ion source vacuum region from the mass detector vacuum region and allows each region to be separately pumped and to have different operating pressures.

Many designs are possible for the photoionizer 204. In the embodiment shown, atmospheric air or other gaseous mixture may be allowed to enter the ionizer through a valve, or aperture, and/or a thin tube. The pressure in the photoionizer 204 may be sub-atmosphere, typically being about 1 torr, but can operate from $10^{-3}$ torr to greater than 10 torr, even up to atmosphere. Ions that are formed in the photoionizer 204 are extracted through an aperture that leads to the ion trap 208. The ions are steered and accumulated and ejected from the trap 208 and into the detector 212 in a manner similar to the description given for monitor 100 shown in FIG. 1.

The photoionizer may include a light source which emits a light beam which has a wavelength so that photo-energy between 8.0 and 12.0 electron volts (eV) is delivered to the gas sample. Photo-energy between 8.0 and 12.0 is high enough to ionize most trace molecules of interest without creating much molecular fragmentation within the sample. By way of example the light source may be a Nd:YAG laser which emits light at a wavelength of 355 nanometers (nm). The 355 nm light may travel through a frequency tripling cell that generates light at 118 nms. 118 nm light has an energy of 10.5 eV. Such a light source is described in U.S. Pat. No. 5,808,299 issued to Syage, which is hereby incorporated by reference. Alternatively, the light source may include continuous or pulsed discharge lamps which are disclosed in U.S. Pat. No. 3,933,432 issued to Driscoll; U.S. Pat. No. 5,393,979 issued to Hsi; U.S. Pat. No. 5,338,931 issued to Spangler et al. and U.S. Pat. No. 5,206,594 issued to Zipf, which are hereby incorporated by reference.

Figure 4:
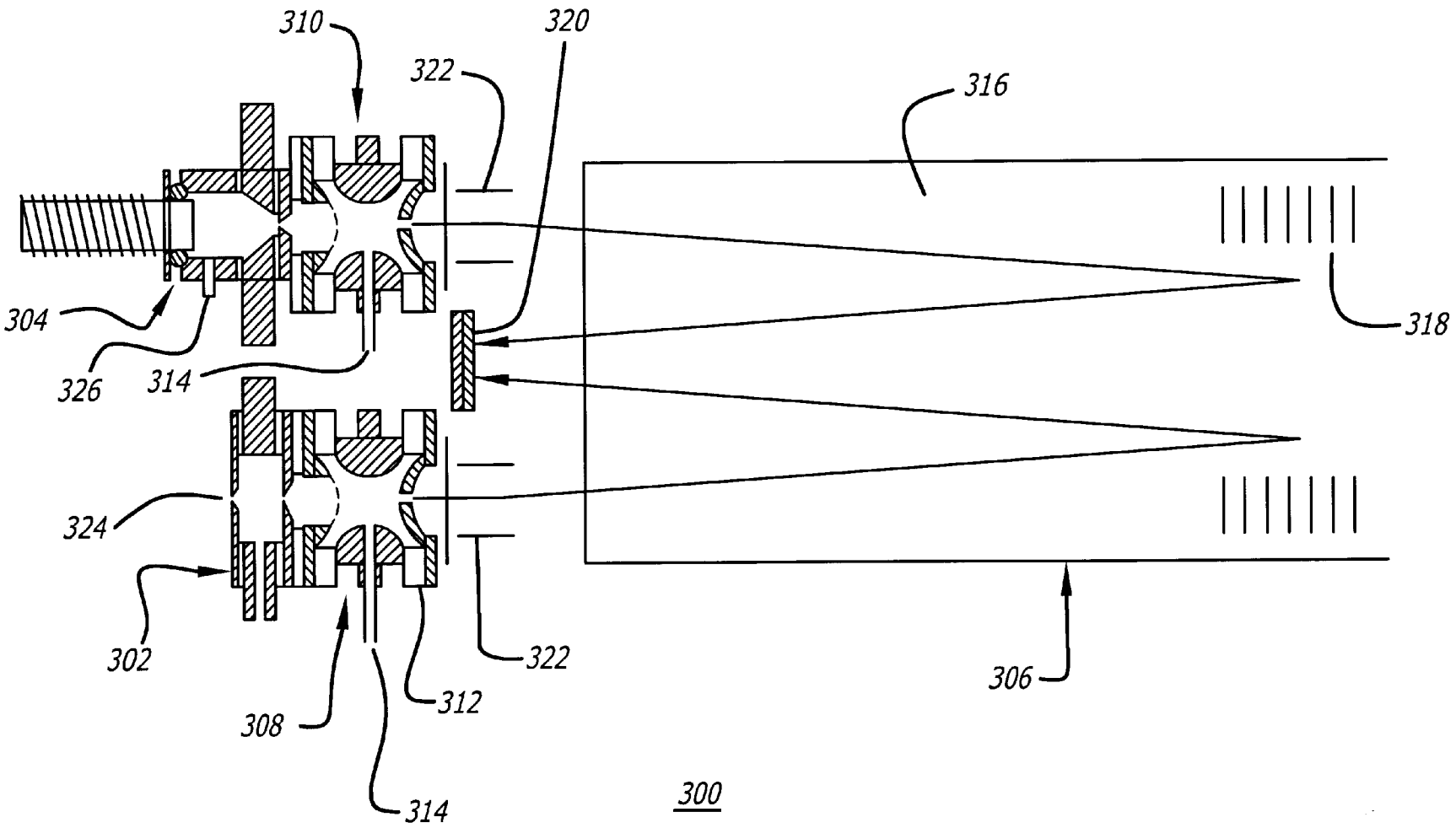
FIG. 4 is a schematic representation of an alternate embodiment of the monitor.

FIG. 4 shows an embodiment of a monitor 300 which has a glow discharge ionizer 302 and a photoionizer 304 coupled to the same mass detector 306. Each ionizer 302 and 304 can be coupled to the mass detector 306 by a quadrupole ion trap 308 and 310, respectively. The ion traps 308 and 310 can be connected to the ionizers 302 and 304 so that the ions exiting the ionization source directly enter the traps without requiring ion focusing elements. In this and other embodiments, the spacers that seal the ion traps 308 and 310 from the surrounding vacuum chamber, 312 in FIG. 4 and 127 in FIG. 1 may be removed so that the traps 308 and 310 can be pumped out. This may be used very effectively for the directly coupled ionizer/trap configuration to allow increased sample throughput into the traps. The quadrupole ion traps 308 and 310 may have ports 314 or open area that are coupled to a pump (not shown). The ports can be used to pump out the ion traps, or introduce a gas other than the sample gas, such as helium, which has been shown in previous work to effectively cool ions in the traps.

The monitor 300 in FIG. 4 shows an embodiment whereby the ions that exit each trap 308 and 310 enter the same mass detector 306. The mass detector 306 may be a time of flight mass spectrometer which includes a drift tube 316, reflectron 318 and detector plate 320. In order to separate the recorded mass spectrum from each ion source, the ions from each ion trap 308 and 310 can be pulsed into the mass detector 306 at different times. The monitor 300 may have electrostatic steering optics such as a simple deflector 322 for this purpose to steer the ions from the traps 308 and 310 in a direction that will insure detection by plate 320.

If ions of the same charge are detected from each quadrupole ion trap 308 and 310, then the detection follows the prescription described earlier and the operation of the mass detector 306 may operate in a conventional manner. If ions of different charge exit each trap 308 and 310, such as is the case for the glow discharge ionizer 302 in electron attachment, negative ion mode, and the photoionizer 304 in positive ion mode, then the voltages on the drift tube 316, the reflectron segment 318 and the detector 320 must be switched according to the conditions that are appropriate for the charge being detected. Standard electronic methods may be used to achieve switching in the time period after the recording of one mass spectrum and before the extraction of the ions from the other trap 308 or 310.

The monitor 300 may have separate sample inlet ports 324 and 326 for the glow discharge ionizer 302 and photoionizer 304, respectively. In one embodiment, these sample inlets 324 and 326 are connected so that the same sample is split and enters both ionizers 302 and 304. It is also possible to use each ionizer and mass analyzer for separate samples.

The embodiments in FIG. 4 represent a variety of options that may be applied separately or in combination to achieve a variety of configurations tailored for specific applications.

Figure 5:
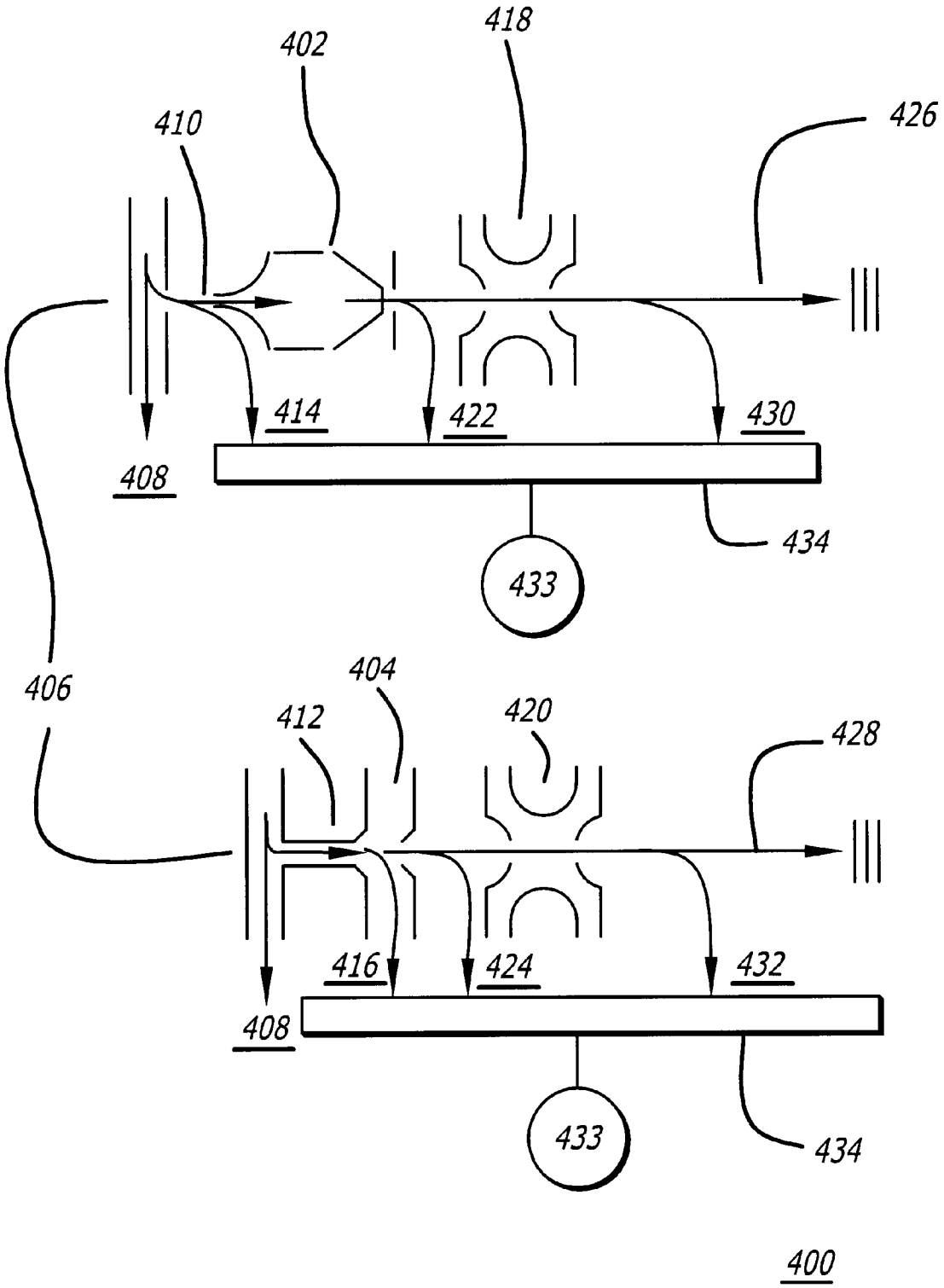
FIG. 5 is a schematic representation showing fluid flow through the monitor.

FIG. 5 shows an embodiment of sample gas flow partitioning systems for a photoionizer 402 and a glow discharge ionizer 404 that achieve high sample throughput while minimizing the gas load on the vacuum systems. A sample consisting of trace compounds in air or other gases can be delivered to the inlet system of the glow discharge ionizer 404 or the photoionizer 402. A sample may be introduced through tubes 406 which have inlets 408 that are coupled to a pump (not shown) which draws in a sample. Alternatively, the sample may be delivered by exposure to ambient air without a sampling tube, a preconcentrator device such as a momentum impactor device for particles, a mesh, an electrostatic precipitator for particles and vapor, or by other means.

A portion of the air sample flow, constituting the first stage of partitioning enters the ionizers 402 and 404 through an aperture 410 for glow discharge ionizer 402 and through either an aperture or a jet separator 412 for the photoionizer 404. If a jet separator is used then the usual skimmed flow is pumped away along an airstream 414. For the glow discharge ionizier 402, the air entering the ionizer chamber is pumped away along airstream 416. This bypass pumping and the resultant advantages were described earlier when referring to number 114 in FIG. 1. The glow discharge partitioning 414 and the optional photoionizer jet separator partitioning 416 constitute the second stage of flow partitioning.

The third stage of flow partitioning occurs in the regions between the ionizer exit apertures and the quadrupole ion trap entrance apertures of the ion traps 418 and 420, along flow streams 422 and 424, respectively. The traps 418 and 420 may be coupled to mass detectors 426 and 428, respectively. The mass detectors 426 and 428 can be evacuated by flow streams 430 and 432, respectively. Only a small fraction of the neutral background air or gas enters the traps 418 and 420 and hence the final gas load on the mass detectors 426 and 428 is minimized. The requirements for vacuum partitioning denoted by 422 and 430 for the photoionizer section, and 424 and 432 for the glow discharge section can be met by available split-flow or multi-ported turbomolecular pumps, although other pumps and separate pumping may also be used. An example of operating pressures in the source and mass detector regions is about $10^{-3}$ torr and about $10^{-5}$ torr, respectively, although these regions can operate at higher or lower pressures. For the embodiment 400 described by FIG. 5, the source and mass detector vacuum sections can be connected, such that a single multi-ported pump 433 and corresponding manifold 434 can be used for the glow discharge source and the dual photoionizer configuration.

The intent for each stage of flow partitioning is to achieve enrichment of the target compounds and ions in the background air or gas. In the sample delivery stage, this may be effected by using a preconcentrator or other device as noted above. In the second stage, a jet separator achieves mass focusing whereby higher molecular weight compounds are enriched along the centerline, which is the portion that enters into the photoionizer 404. A similar effect occurs for the glow discharge ionizer 402 in which higher molecular weight ions may be enriched along the centerline, which is aligned with the exit aperture. The third stage achieves very effective enrichment because the ions exiting the ionizers 402 and 404 can be focused into the traps 418 and 420, whereas the exiting neutral gas disperses and is mostly pumped along 422 and 424.

Figure 6:
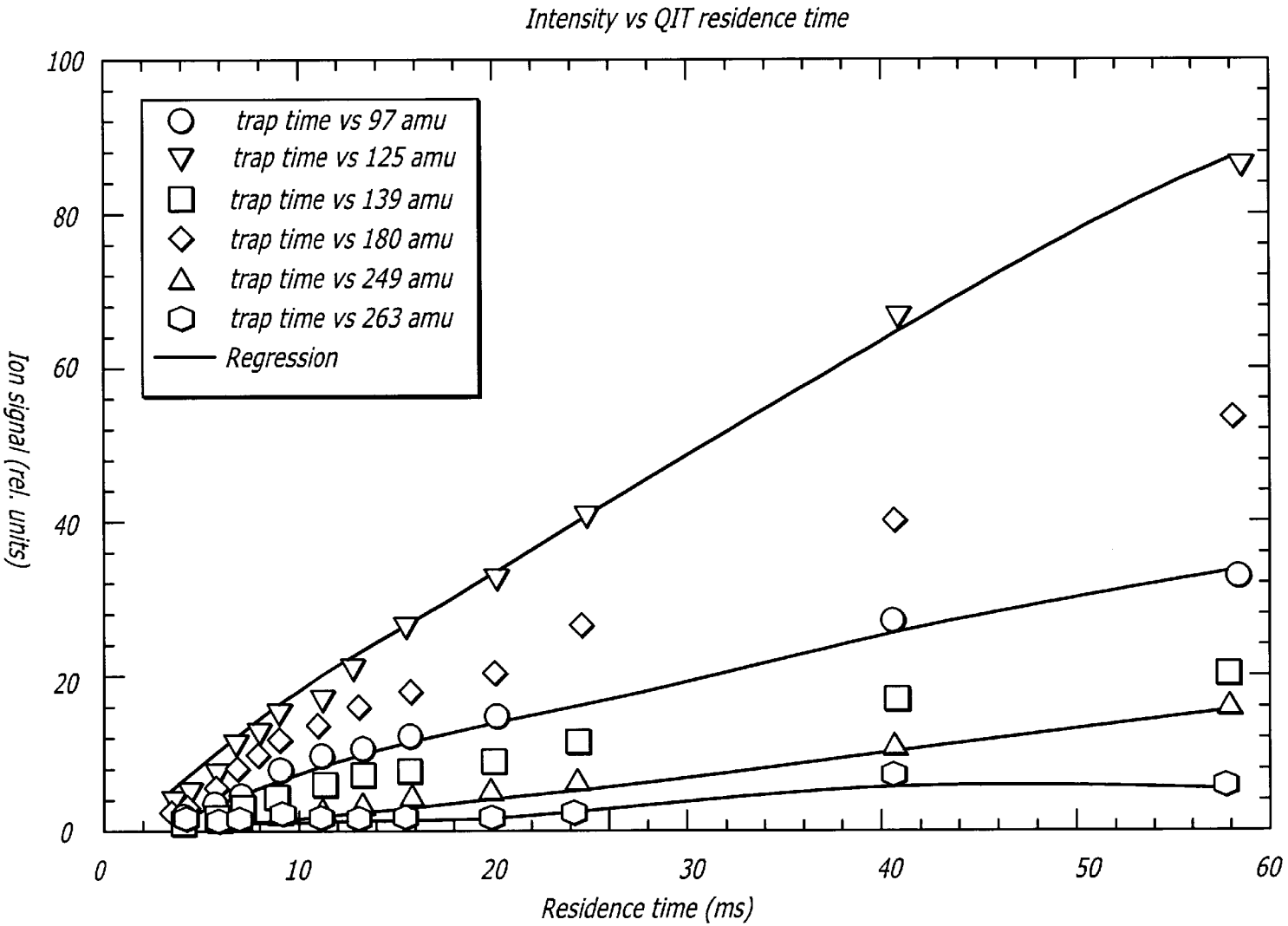
FIG. 6 is a graph which shows signal levels as a function of residence time to show the potential to achieve high dynamic range.
Figure 7:
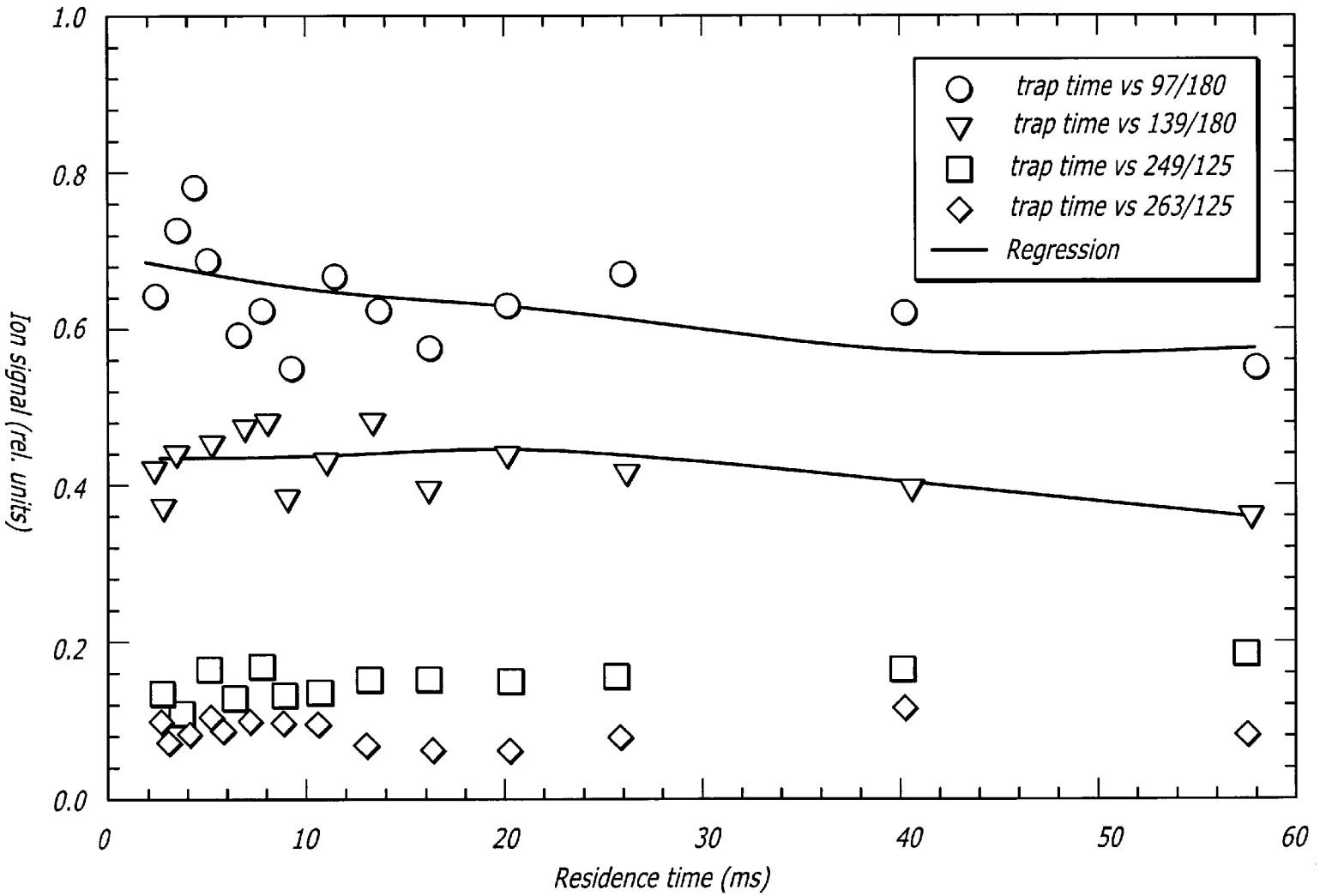
FIG. 7 is a graph which shows reduced ion-molecule association in a quadrupole ion trap using air sampling as measured by ion trap residence time.

FIGS. 6 and 7 show results which demonstrate the benefits of the combined quadrupole ion trap/time of flight mass spectrometer ("QIT/TOFMS") vs. an ion trap mass spectrometer ("ITMS")for use with continuous ionization sources such as glow discharge and photoionization. To achieve the highest levels of sensitivity and dynamic range, it is advantageous to use a method of mass analysis that has a high duty cycle for ion collection. The use of a quadrupole ion trap as an interface between a continuous ionization source such as glow discharge and a pulsed mass analyzer such as time of flight mass spectrometer has significant advantages over the use of an ITMS, or an orthogonal extraction time of flight mass spectrometer.

Figure 8:
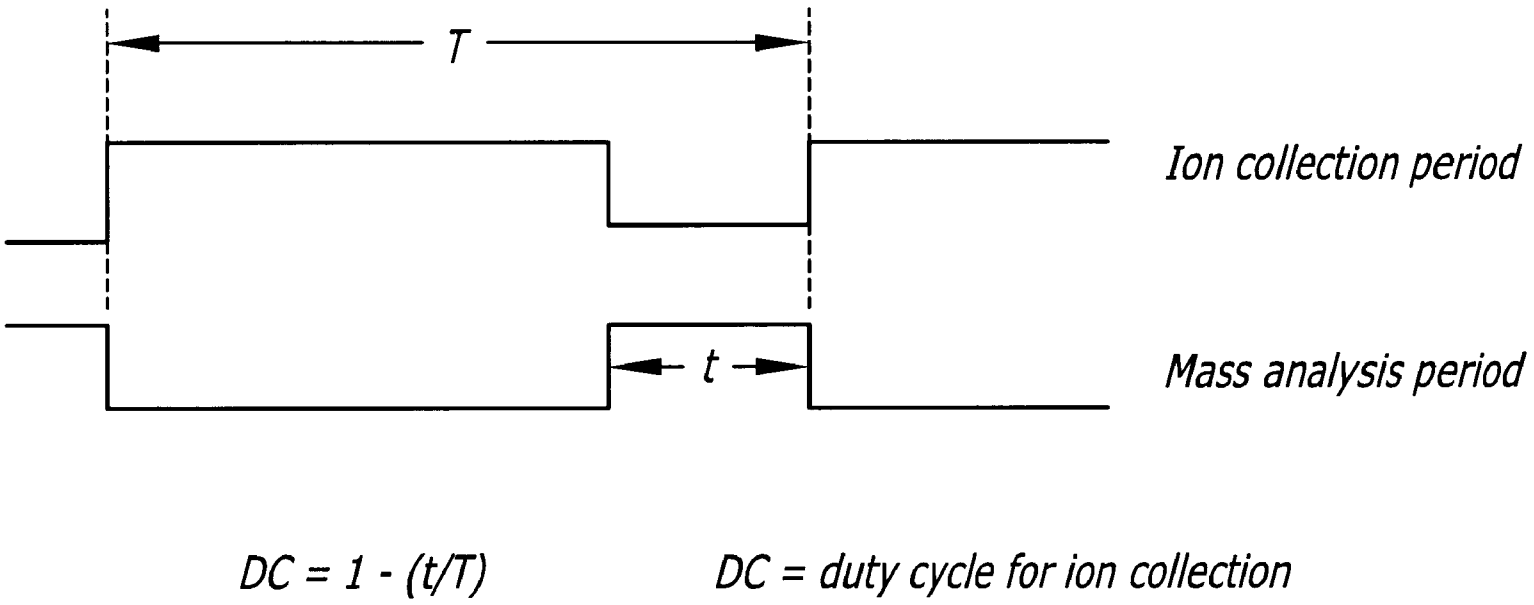
FIG. 8 is a diagram showing the ion collection and ion scan periods for operation by a QIT/TOFMS and an ITMS.

The advantage of ion trap over orthogonal extraction TOFMS is (1) higher ion collection efficiency, and (2) capability to perform specific ion rejection and specific collision-induced dissociation (CID). The QIT/TOFMS mass analyzer and ITMS operate similarly with regard to ion collection, ion rejection and CID. However as noted above, the principal difference is in the method of mass analysis. The ITMS uses mass-selective instability to sequentially scan out ions of increasing mass from the trap, whereas QIT/TOFMS uses a high voltage pulse to inject all the ions into a TOFMS for mass analysis. There are three main advantages of QIT/TOFMS compared to ITMS:

(1) The ion ejection time is significantly less for QIT/TOFMS vs ITMS (about 5–10 microsecond vs 1–100 millisecond, respectively). Because ion collection must be turned off during the mass analysis period, the longer mass analysis period for ITMS limits how the high repetition rate may be set before the duty cycle for ion collection becomes small. Referring to FIG. 8 the detection duty for an ITMS is 1–(t/T) where t is the mass scan out time and T is the time between collection periods. By way of example a 50% duty cycle corresponds to a repetition rate of 10 Hz for a 50 ms mass analysis time and to 50 Hz for a 10 ms analysis time. QIT/TOFMS achieves nearly a 100% ion collection duty cycle up to repetition rates as high as and greater than 1 kHz. Excellent signal linearity is observed in FIG. 6 for collection periods (inverse repetition rate) ranging from 3 ms to 60 ms. If MS/MS is employed, then the duty cycle for ion collection will decrease due to the finite time required to effect CID in the trap. By using air as a carrier gas and operating the trap at relatively high pressures (a few m-torr), we anticipate time periods for sufficient CID to be about 10 ms, based on some preliminary observations. An alternative method to avoid the ion collection "down time" is to use notch filtering whereby a selected set of parent and daughter ion masses is stabilized and the remaining masses destabilized using the appropriate RF waveform. In this case, the parent ions would be excited to induce CID, without fully ejecting them from the trap. Other multiplexed MS/MS routines may be incorporated and benefit from the high repetition rates achievable by QIT/TOFMS.

(2) Mass resolution and mass analysis ejection efficiency is less sensitive to space charge repulsion for QIT/TOFMS than for ITMS allowing a higher ion storage capacity. The ITMS method requires that the Mathieu parameter q for each ion mass be constant for high mass resolution in the RF scan out. Space charge repulsion can broaden the apparent q value and consequently the mass resolution. For QIT/TOFMS a HV pulse out is less sensitive to space charge repulsion for the following reasons: (i) The broadening effects of the energy spread of the ions due to space charge repulsion can be minimized by increasing the drift length and TOF voltage. (ii) Broadening due to the ion energy spread can be refocused using a reflectron TOFMS. Significantly greater QIT ion capacities have been measured by us for QIT/TOFMS than reported by commercial instrument manufacturers for ITMS. A possible limitation on trap capacity may occur when using the selective ion rejection mode for ion collection because severe space charge may broaden the resonance spectrum of each ion mass. However, to the extent that unit mass resolution is not needed for resonance ejection, a higher ion capacity may be used compared to the limit value for ITMS instruments.

(3) Ion mass signals appear within significantly narrower time window for QIT/TOFMS vs ITMS (typically 50–100 nanoseconds vs about 100 microseconds, respectively), leading to potentially better signal-to-noise ratios for the former technique. A given number of ions will produce a larger peak current (or voltage) if they are detected in a shorter period of time. Narrower time bins per unit mass also lead to proportionately better noise immunity since less instrument noise is collected. However, note that chemical noise, defined as signal from ions of the same mass as the analyte, is not reduced by using narrower time bins.

The potential for operating at higher repetition rates by QIT/TOFMS vs. ITMS also offers the potential for higher detection dynamic range by the former method. The repetition rate enables control over the maximum number of ions that accumulate in the trap. Too many ions in the QIT can lead to spectral broadening and other known undesirable effects. By increasing the maximum repetition rate, the range of detectable ions per unit time is increased proportionately. This feature in addition to the greater number of ions that may be stored in the QIT using TOFMS analysis vs.

mass-selective instability scanning as described earlier, leads to a potential improvement in dynamic range of about 1–2 orders of magnitude for QIT/TOFMS vs ITMS.

FIG. 7 shows QIT/TOFMS mass spectral intensities recorded for repetition rates ranging from 17 Hz to 304 Hz (residence time of 59 and 3 ms, respectively) for a sample of 5 ppm DIMP (180 molecular weight) and 9 ppm DMMP (124 molecular weight) in room air. Excellent linearity is observed over this range for all signals (97 and 139 amu are fragments of DIMP parent ion at 180 amu; DMMP is observed as a protonated ion at 125 amu, and ion clustering is observed at 249 and 263 amu). Ion molecule reactions, such as clustering and dissociation can occur in the QIT, which may be undesirable for certain applications. The extent of reaction can be tested by varying the residence or reaction time in the QIT. FIG. 7 shows the ratio of the DIMP fragment ions at 97 and 139 amu relative to the parent ion at 180 amu. These ratios show a slight dependence, however for the typical condition of 40 Hz (25 ms residence time), the extent of reaction is not significant. The effect of ion-molecule association (clustering) is also not significant in the QIT as measured by the ratio of DMMP dimer ion to monomer ion (protonated signal 249 amu/125 amu) and to the DIMP 139 amu fragment and DMMP parent cluster (263 amu/125 amu). The ion clusters have been shown to occur in the PI source and can be minimized by reducing the PI source pressure.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A monitor that can detect at least one trace molecule within a gas sample, comprising:

a glow discharge ionizer which can ionize the trace molecule, said glow discharge ionizer operating at a pressure significantly less than atmospheric pressure;

an ion trap which traps the ionized trace molecule; and, a time of flight analyzer that is coupled to said ion trap and which can detect the ionized trace molecule.

2. The monitor of claim 1, wherein said ion trap applies a voltage that has a frequency to the ionized trace molecule, wherein the voltage frequency can be varied to selectively eject the ionized trace molecule into the time of flight analyzer.

3. The monitor of claim 1, further comprising a pump system that pulls air from a location upstream from said glow discharge ionizer, a location upstream from said ion trap and a location upstream from said time of flight analyzer.

4. The monitor of claim 1, further comprising a photoionizer that can ionize a trace molecule.

5. The monitor of claim 4, further comprising an ion trap which traps the trace molecule ionized by said photoionizer.

6. The monitor of claim 5, wherein said ion trap applies a voltage to the ionized trace molecule, wherein the voltage can be varied to selectively eject the ionized trace molecule into said time of flight analyzer.

7. A monitor that can detect a first trace molecule and a second trace molecule within a gas sample, comprising:

a glow discharge ionizer which can ionize the first trace molecule;

a glow discharge mass detector that is coupled to said glow discharge ionizer and which can detect the ionized first trace molecule;

a photoionizer which can ionize the second trace molecule; and a photoionizer mass detector that is coupled to said photoionizer and which can detect the ionized second trace molecule.

8. The monitor of claim 7, further comprising a glow discharge ion trap that traps the ionized first trace molecule, and a photoionizer ion trap that traps the ionized second trace molecule.

9. The monitor of claim 8, wherein said glow discharge ion trap and said photoionizer ion trap each apply a voltage to the ionized first and second trace molecules, respectively, wherein the voltage can be varied to selectively eject the ionized first and second trace molecules into said mass detectors.

10. The monitor of claim 8, wherein said time of flight analyzer includes a coaxial detector.

11. The monitor of claim 7, wherein said glow discharge mass detector and said photoionizer mass detector each include a time of flight mass analyzer.

12. The monitor of claim 7, further comprising a pump that pumps out a non-ionized trace molecule.

13. A monitor that can detect a first trace molecule and a second trace molecule within a gas sample, comprising:

a glow discharge ionizer which can ionize the first trace molecule;

a photoionizer which can ionize the second trace molecule; and a mass detector that is coupled to said glow discharge ionizer and said photoionizer and which can detect the ionized first and second trace molecules.

14. The monitor of claim 13, further comprising a glow discharge ion trap that traps the ionized first trace molecule, and a photoionizer ion trap that traps the ionized second trace molecule.

15. The monitor of claim 14, wherein said glow discharge ion trap and said photoionizer ion trap each apply a voltage to the ionized first and second trace molecules, respectively, wherein the voltage can be varied to selectively eject the first and second ionized trace molecules into said mass detector.

16. The monitor of claim 13, wherein said mass detector includes a time of flight mass analyzer.

17. The monitor of claim 13, further comprising a pump that pumps out a non-ionized trace molecule.

* * * * *